United States Patent [19]

Keisler

[11] 4,297,823

[45] Nov. 3, 1981

[54] HOLLOW WALL REPAIR DEVICE

[76] Inventor: Carl E. Keisler, 3629 Camelot Dr., Annandale, Va. 22003

[21] Appl. No.: 141,258

[22] Filed: Apr. 17, 1980

[51] Int. Cl.[3] ..... E02D 37/00

[52] U.S. Cl. ..... 52/514; 52/509

[58] Field of Search ..... 52/509, 514; 156/98

[56] References Cited

U.S. PATENT DOCUMENTS

| | | | |
|---|---|---|---|
| 2,997,416 | 8/1961 | Helton | 52/514 X |
| 3,874,505 | 4/1975 | Mirarchi et al. | 52/514 X |
| 3,936,988 | 2/1976 | Miceli | 52/514 |
| 4,100,712 | 7/1978 | Hyman | 52/514 |
| 4,152,877 | 5/1979 | Green | 52/514 |
| 4,193,243 | 3/1980 | Tiner | 52/514 |

*Primary Examiner*—Carl D. Friedman

*Attorney, Agent, or Firm*—Mawhinney & Mawhinney & Connors

[57] ABSTRACT

Apparatus is disclosed for repairing holes in hollow walls such as wallboard or sheetrock or the like. The apparatus comprises an interior plate having a positioner guide thereon so that when the interior plate is inserted through the hole to be repaired the positioner guide may rest on one side of said hole as the interior plate abuts the interior surface of the wall and covers the hole. A surface plate is sized to fit securely and firmly into the hole and has retainer clips at each side thereof to retain and position the surface of the surface plate flush with the surface of the wall. A positioner wire extends through both the interior plate and the surface plate and allows the interior plate to be pushed through the wall opening and then to be pulled back into proper position relative to the surface plate. An attaching bolt is extended through the surface plate and engages a nut fixed to the interior plate to securely fasten the surface plate in the hole.

8 Claims, 5 Drawing Figures

HOLLOW WALL REPAIR DEVICE

BACKGROUND OF THE INVENTION

The present invention relates generally to wall repair apparatus and, more particularly, to a device for repairing holes in hollow walls such as those constructed of sheetrock at places where fixtures were attached but have come loose to leave a relatively small hole in the wall.

Present day wall construction techniques used in homes and buildings involve the nailing of sheetrock or wallboard panels directly to the wall studs to make what are commonly called hollow walls. Although such hollow walls have the advantage of relativey easy and inexpensive construction, they are very susceptible to damage by having holes knocked therein, and also by having fixtures, such as towel bars and soap dishes, as are commonly attached to bathroom and kitchen walls by screws to come loose and to make relatively small holes in the wall. Repairs to damaged hollow walls have been difficult because of the lack of structure behind the wall to receive and support the repair materials and also because of the difficulty of positioning a repair section in a hole to be flush with the adjacent wall surface. Additionally, such repairs to hollow walls have not produced surfaces capable of withstanding the forces involved in reattaching fixtures at places where repairs have been made.

Attempts have been made in the prior art to overcome some of these difficulties encountered in the repair of holes in hollow walls. U.S. Pat. No. 2,997,416 discloses apparatus for repairing hollow walls comprising a complex bracing apparatus which holds a backing plate over a hole while the repair is effected. U.S. Pat. No. 3,717,970 discloses a wallboard repair device comprising a slidable apparatus which is adjustable to fit holes of various sizes. U.S. Pat. No. 3,874,505 discloses a kit for repairing hollow walls comprising a repair patch mounted on an adhesive bearing backboard which holds the repair patch in the hole. U.S. Pat. No. 3,995,404 discloses an attachment for holding a replacement panel in an opening in a hollow wall comprising clips adapted to attach at each side of the opening. None of these patents disclose or suggest a hollow wall repair device like the repair device disclosed herein. None of these patents disclose hollow wall repair apparatus particularly adapted to repair relatively small holes such as appear at places where wall fixtures have broken loose. None of these patents disclose hollow wall repair apparatus comprising a hole-covering interior plate having a positioner guide and a surface plate having retaining clips which position the surface place flush with the wall surface.

SUMMARY OF THE INVENTION

Accordingly, it is an object of the present invention to provide apparatus for repairing holes in hollow walls wherein the repaired section can withstand forces applied during the attachment of fixtures at the location of the repairs.

It is a further object of the present invention to provide apparatus for repairing holes in hollow walls wherein a surface plate and an interior plate carry positioning and retaining means for locating and holding the plates in the hole to be repaired.

It is a further object of the present invention to provide apparatus for repairing holes in hollow walls which can be manufactured as a kit for sale to homeowners.

It is a further object of the present invention to provide apparatus for repairing holes in hollow walls wherein a surface plate fits securely and firmly into a hole prepared in a hollow wall and wherein fixture brackets may be screwed into the surface plate for a rigid attachment.

The present invention is summarized in that a hollow wall repair device comprises an interior plate with a positioner guide thereon and a surface plate with retaining clips thereon, whereby when the interior plate is placed inside the wall and over a hole therein and said surface plate is placed within said hole and attached to said interior plate the surface plate will be flush with the hollow wall surface adjacent the repair area.

DESCRIPTION OF THE PREFERRED EMBODIMENT

Figure 1:
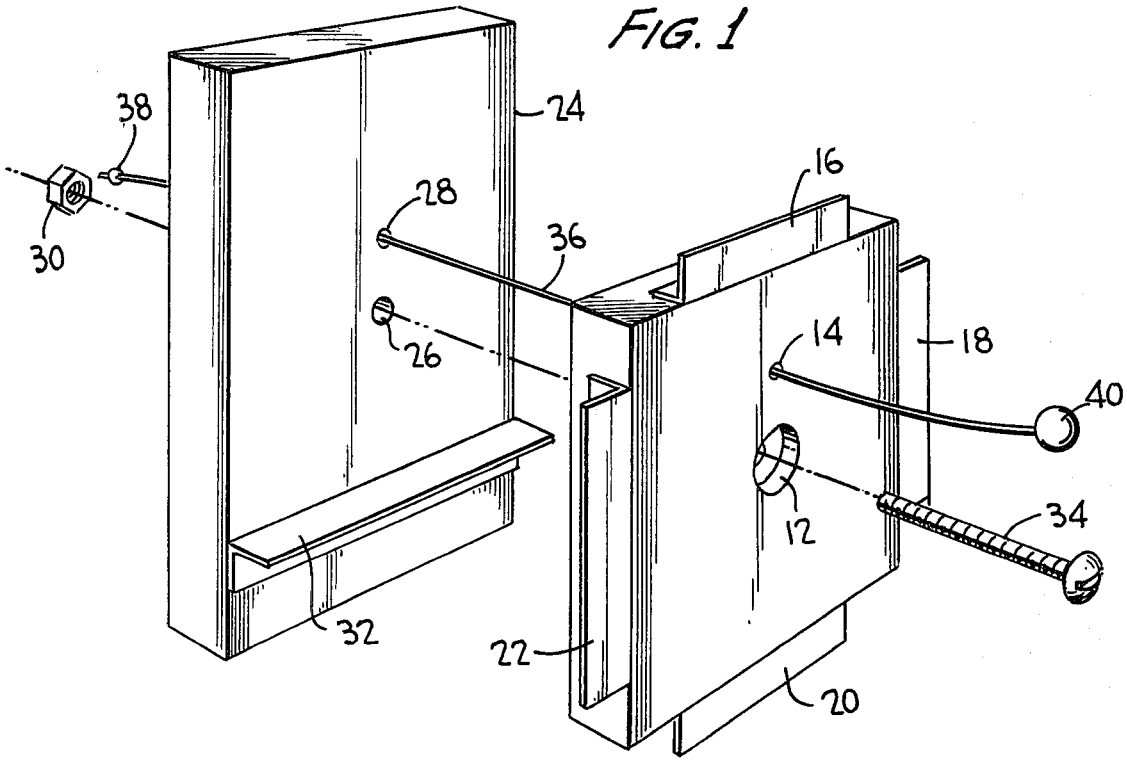
FIG. 1 is a perspective view partially exploded, of the hollow wall repair device of the present invention.

Referring now to the drawings, and in particular to FIG. 1, there is illustrated the hollow wall repair device of the present invention. A surface plate 10 is square and made of plywood and functions to fill a prepared hole in a sheetrock hollow wall. An attaching bolt hole 12 is located at the center of surface plate 10 and a positioner wire hole 14 is located above the bolt hole 12. Sheet metal retainer clips 16, 18, 20 and 22 are L-shaped and attached to the sides of the surface plate 10. The wing portions of the retainer clips are level or flush with the top surface of plate 10 as shown. The retainer clips function to hold the surface plate flush with the surface of the wall.

An interior plate 24 is rectangular in shape and made of plywood and functions to allow the surface plate 10 to adhere to a desired location in the wall. An attaching bolt hole 26 is located at the center of plate 24 and a positioner wire hole 28 is located above the bolt hole 26. A threaded attaching nut 30 is securely attached to the rear side of interior plate 24 to align with the bolt hole 26. A sheet metal, L-shaped positioner guide 32 is attached to the face of interior plate 24 at a location determined by the relative size of the surface plate 10 as discussed below. The positioner guide 32 functions to allow the interior plate 24 to be aligned in proper position relative to the surface plate 10 to align the bolt holes 12 and 26 for proper installation of an attaching bolt 34.

A positioner wire 36 extends through the surface plate 10 and interior plate 24 and has a knot tied in each end thereof. The end of positioner wire 36 adjacent surface plate 10 should have a cover 40 over the knot (not shown) to protect the user's hands during installation. Positioner wire 36 functions to allow interior plate 24 to be inserted through a wall opening and then to be pulled back into proper position for attaching the surface plate to the interior plate.

Figure 2:
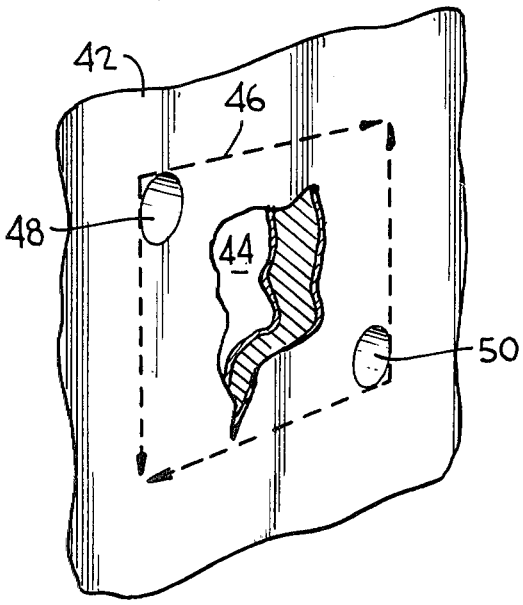
FIG. 2 is a fragmentary perspective view of a damaged section of a hollow wall illustrating the use of a template as preparatory to use of the repair device of the present invention.
Figure 3:
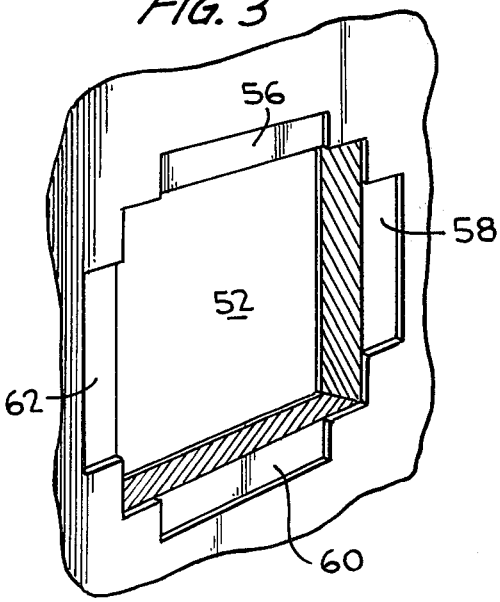
FIG. 3 is a fragmentary perspective view of the hollow wall section of FIG. 2 with the damaged portion removed and showing the recesses cut in the hollow wall to receive the surface plate retainer clips.

Referring now to FIGS. 2 and 3, the steps involved in preparing a damaged section of sheetrock by the repair device of the present invention is illustrated. FIG. 2 shows a section of sheetrock wall 42, having a hole or damaged area 44 therein. A template which can be included with the repair kit is used to draw an outline 46 around the hole 44. At this point it is important for the user to determine that proposed hole within the outline 46 does not extend into a stud. If a stud is found within or behind wall area 46, then the hole must be redrawn to avoid the stud. After outline 46 is drawn, a drill is used to bore holes 48 and 50 at opposite corners of proposed hole 46. Then using a keyhole or saber saw a cut is made along outline 46 to make a hole as shown at 52 in FIG. 3.

Figure 4:
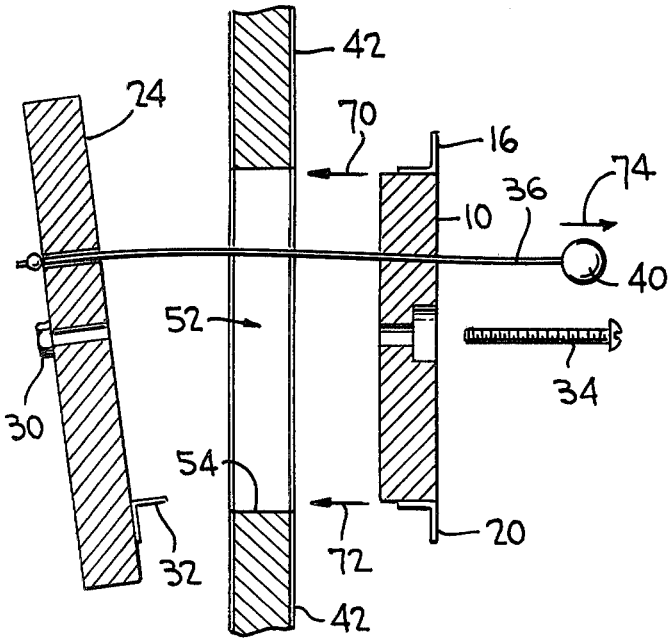
FIG. 4 is a side view of the repair device positioned for, but prior to, attachment to the wall.
Figure 5:
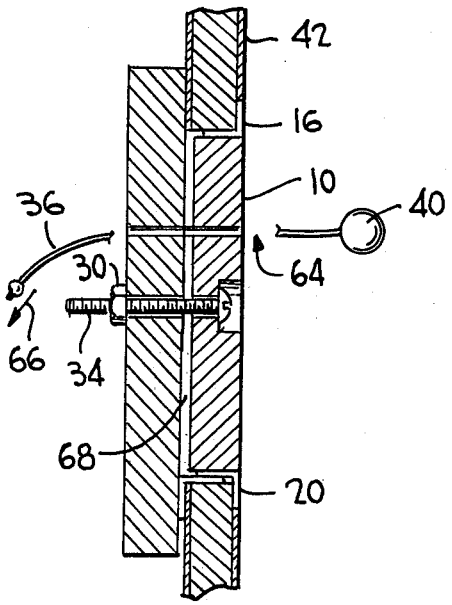
FIG. 5 is a side view of the repair device secured in place within a hollow wall.

Referring now to FIG. 4, the next step is to push the interior plate 24 through prepared hole 52. Then, using positioner wire 36, the interior plate 24 is pulled into place whereby the positioner guide 32 is resting on the bottom, rear, interior part 54 of prepared hole 52. Next, with one hand holding positioner wire 40, the surface plate 10 is moved into place into the prepared hole 52 and the attaching bolt is finger tightened. After the surface plate 10 is inserted in hole 52 and bolted to interior plate 24, an outline of the retainer clips is drawn onto the adjoining drywall (FIG. 3). Then the attaching bolt is loosened and the surface plate is pulled away from the hole 52. Next a cutting tool is used to cut an outline of the retainer clips into the adjoining drywall, cutting only the cardboard surface to a depth equal to the thickness of the retainer clips. Then the cardboard is removed down to the underlayer as shown at 56, 58, 60 and 62 in FIG. 3. Finally, the surface plate is reinserted into the hole 52 and bolted tightly as shown in FIG. 5. As seen in FIG. 5, when finally assembled there is a small gap 68 between surface plate 10 and interior plate 24. The user may now cut the positioner wire 36 as indicated at 64, whereby the inner part of wire 36 will fall away as indicated by arrow 66. The user can now apply compound and joint tape to effect an invisible, smooth and strong repair.

The device disclosed herein is designed to be manufactured as a kit for sale to homeowners to repair holes in sheetrock or hollow walls. Although all holes in sheetrock walls can be repaired, this device is especially designed to repair holes in bathroom or kitchen walls where fixtures were attached, such as towel bars, soap dishes, etc., and that have come loose and caused a hole in the wall where the fixture was attached. The device fits securely and firmly into a hole prepared in walls and fixture brackets may be screwed, but not hammered, into the hole repair device for a firm fit. It should be noted that hammering or pounding on the device may cause damage to the surrounding wall.

The illustrations and descriptions depict the surface plate of the device at approximately $1\frac{3}{4}''$ square which would repair a hole of the same size, however, the device could be manufactured in various sizes to accommodate varying needs of consumers. It should be noted that the width of the surface plate and the interior plate must always be the same regardless of the overall size of the device. The interior plate should always be at least $2''$ to $4''$ longer than the surface plate making it $1''$ to $2''$ or more longer than the surface plate on each end.

The illustrations and descriptions also depict the thickness of the surface plate at $\frac{1}{2}''$. This thickness could be varied for various thicknesses of drywall. The thickness of the wall could also be compensated for by by adding a thickness of cardboard, or other similar material, to the ends of the interior plate that rest on the back or inside of the drywall. In other words, by adding $\frac{1}{8}''$ of thickness to both ends of the interior plate the surface plate at $\frac{1}{2}''$ would fit firmly into a hole in $\frac{3}{8}''$ drywall.

The illustrations depict the attaching mechanism as one bolt in the center of the surface plate going through the surface plate to a nut attached to the rear of the interior plate. With larger size hole repair units, the attaching mechanism could very well be 4 bolts, one in each corner of the surface plate to a nut attached to the rear of corresponding holes in the rear of the interior plate.

The surface of the surface plate, including the retainer clips, could be covered with joint tape, or other similar materials, to simulate the surface of the adjoining wall. This would insure that the hole repair device, when properly patched with joint compound, would make for an invisible, smooth repair.

It should be reiterated that the descriptions and illustrations that follow are for only one size of hole repair device. Many different sizes using different thicknesses of materials could be made using the same overall mechanism.

Size of Model Components

Surface Plate—$\frac{1}{2}''$ plywood, $1\frac{3}{4}''$ square
Retainer Clips—1/64" sheetmetal, $1\frac{1}{4}''$ long
Interior Plate—$\frac{1}{2}''$ plywood, $3\frac{3}{4}''$ long$\times 1\frac{3}{4}''$ wide
Positioner Guide—1/64" sheetmetal, $1\frac{3}{4}''$ long
Positioner Wire—1/16" wide, 8–12" long
Attaching Bolt—$\frac{3}{8}''$ bolt, $1\frac{1}{2}''$ long It can be readily seen from the foregoing disclosure that there has been described a hollow wall repair device which has use as a home repair kit for repairing damaged sheetrock and drywalls and the like. It is particularly useful for repairing damage caused by fixtures being pulled loose and such repairs are fully capable of withstanding the forces used to reattach such fixtures at the place of repair.

The device of the present invention is also intended to be used for attaching fixtures to sheetrock and drywalls. For such purpose, a hole is made in the wall and then the device is utilized in the same manner as described in the foregoing in regard to the repairing of holes in walls.

Obviously many modifications and variations of the present invention are possible in the light of the above teaching. It is therefore to be understood that within the scope of the appended claims the invention may be practiced otherwise than as specifically described.

What is claimed is:

1. A device for attachment to sheetrock or the like wall boards for repairing holes therein or attaching fixtures thereto comprising:

a surface plate having an area approximately that of the area of an opening in said sheetrock, and having an attaching bolt hole and a positioner hole extending completely therethrough;

retainer means carried by said surface plate and extending laterally outwardly therefrom;

an interior plate having an area larger than the area of said surface plate and said opening in the sheetrock, and having an attaching bolt hole and a positioner hole extending completely therethrough; and a threaded nut securely attached to said interior plate and aligned with said attaching bolt hole;

positioner guide means carried by said interior plate;

an elongated flexible member extending through said positioner holes in said surface plate and said interior plate and having anchoring means at each end thereof, so that said plates may be separated and moved along said flexible member without sliding off said member; and, an attaching bolt for passage through the bolt holes to engage said threaded nut.

2. The invention of claim 1 wherein said retainer means includes retainer clips.

3. The invention of claim 2 wherein said retainer clips are L-shaped and are attached at each side of said surface plate.

4. The invention of claim 3 wherein said surface plate has an outer face and said clips are substantially coplanar with said face.

5. The invention of claim 4 wherein said surface plate is fitted in said opening and held in place coplanar with the outer surface of the sheetrock by said clips with the surface plate being of less thickness than the sheetrock.

6. The invention of claim 1 wherein said interior plate has an inner face and said positioner guide means is a plate that projects outwardly from the inner face to seat on and engage a bounding wall of the opening.

7. The invention of claim 1 wherein said flexible member is a thin wire and said anchoring means includes knots formed in the ends of the wire.

8. The invention of claim 1 wherein said interior plate has a rear face and said nut is attached thereto in alignment with the bolt hole formed therethrough.

* * * * *